United States Patent [19]

Thimons et al.

[11] 4,394,142

[45] Jul. 19, 1983

[54] WATER SPRAY COOLER

[75] Inventors: Edward D. Thimons, Bethel Park, Pa.; Kenneth S. Heller, Newton; John F. McCoy, III, Chelmsford, both of Mass.; Austin Whillier, Johannesburg, South Africa

[73] Assignee: The United States of America as represented by the Secretary of the Interior, Washington, D.C.

[21] Appl. No.: 317,638

[22] Filed: Nov. 2, 1981

Related U.S. Application Data

[63] Continuation of Ser. No. 185,671, Sep. 10, 1980, abandoned.

[51] Int. Cl.[3] ..... B01D 47/00

[52] U.S. Cl. ..... 55/242; 55/259; 55/260; 55/233; 261/98; 261/116

[58] Field of Search ..... 55/90, 228, 233, 250, 55/259, 260, 418, 242; 261/115–118, 98

[56] References Cited

U.S. PATENT DOCUMENTS

| | | | |
|---|---|---|---|
| 2,160,549 | 5/1939 | Kurth | 261/98 |
| 3,038,790 | 6/1962 | Beggs | 261/98 |
| 3,856,487 | 12/1974 | Perez | 55/228 |
| 3,957,464 | 5/1976 | Tellen | 55/85 |
| 4,153,432 | 5/1979 | Beman et al. | 55/90 |

FOREIGN PATENT DOCUMENTS

| | | | |
|---|---|---|---|
| 47018 | 8/1936 | France | 55/260 |
| 54-39378 | 3/1979 | Japan | 55/259 |
| 807517 | 1/1959 | United Kingdom | 55/223 |

*Primary Examiner*—Bernard Nozick
*Attorney, Agent, or Firm*—Thomas Zack; Donald A. Gardiner

[57] ABSTRACT

A water spray cooler with a pair of water collecting mesh structures and having a water spraying nozzle assembly disposed therebetween. Air entering the cooler is directed through the mesh structures and towards a cooler outlet port. The entering air is cooled as it passes through a cool water spray from the nozzle assembly and through the mesh structures which have collected water.

3 Claims, 2 Drawing Figures

WATER SPRAY COOLER

This is a continuation of application Ser. No. 185,671, filed Sept. 10, 1980 now abandoned.

BACKGROUND OF THE INVENTION

1. Field of the Invention

The present invention relates to heat exchangers and, more particularly, is directed towards cooling devices for mines.

2. Description of the Prior Art

Increased heat problems are encountered as mines are worked at greater depths. Generally, the working area of the mine is cooled by a heat exchanger having a plurality of cooling coils and fins through which air passes. Heat exchangers of this type suffer from the disadvantage that dust collects on the air side of the fins and results in inefficient operation. Extensive and costly maintainance procedures are required to keep such systems operational.

SUMMARY OF THE INVENTION

It is an object of the present invention to provide a heat exchanger which does not suffer from the heretofore mentioned disadvantages and limitations.

Another object of the invention is to provide a heat exchanger for efficiently cooling the working area of a mine. The heat exchanger embodying the invention is a direct contact air to water spray cooler having a pair of water collecting mesh structures and a nozzle assembly for spraying cool water. One of the mesh structures is adjacent an inlet port of the spray cooler and the other mesh structure is adjacent an outlet port. The nozzle assembly, which is disposed between the mesh structures, mists the air as it is directed from the inlet port to the outlet port. The mesh structure at the outlet collects mist from the exiting air. The mesh structure at the inlet collects large droplets which fall from the misted air. Warm air entering the inlet is cooled as it passes through the cool water spray and through each mesh structure.

Other objects of the present invention will in part be obvious and will in part appear hereinafter.

The invention accordingly comprises the devices, apparatuses and systems, together with their parts, elements and interrelationships, that are exemplified in the following disclosure, the scope of which will be indicated in the appended claims.

BRIEF DESCRIPTION OF THE DRAWINGS

A full understanding of the nature and objects of the present invention will become apparent upon consideration of the following detailed description taken in connection with the accompanying drawings, wherein.

DESCRIPTION OF THE PREFERRED EMBODIMENTS

Figure 1:
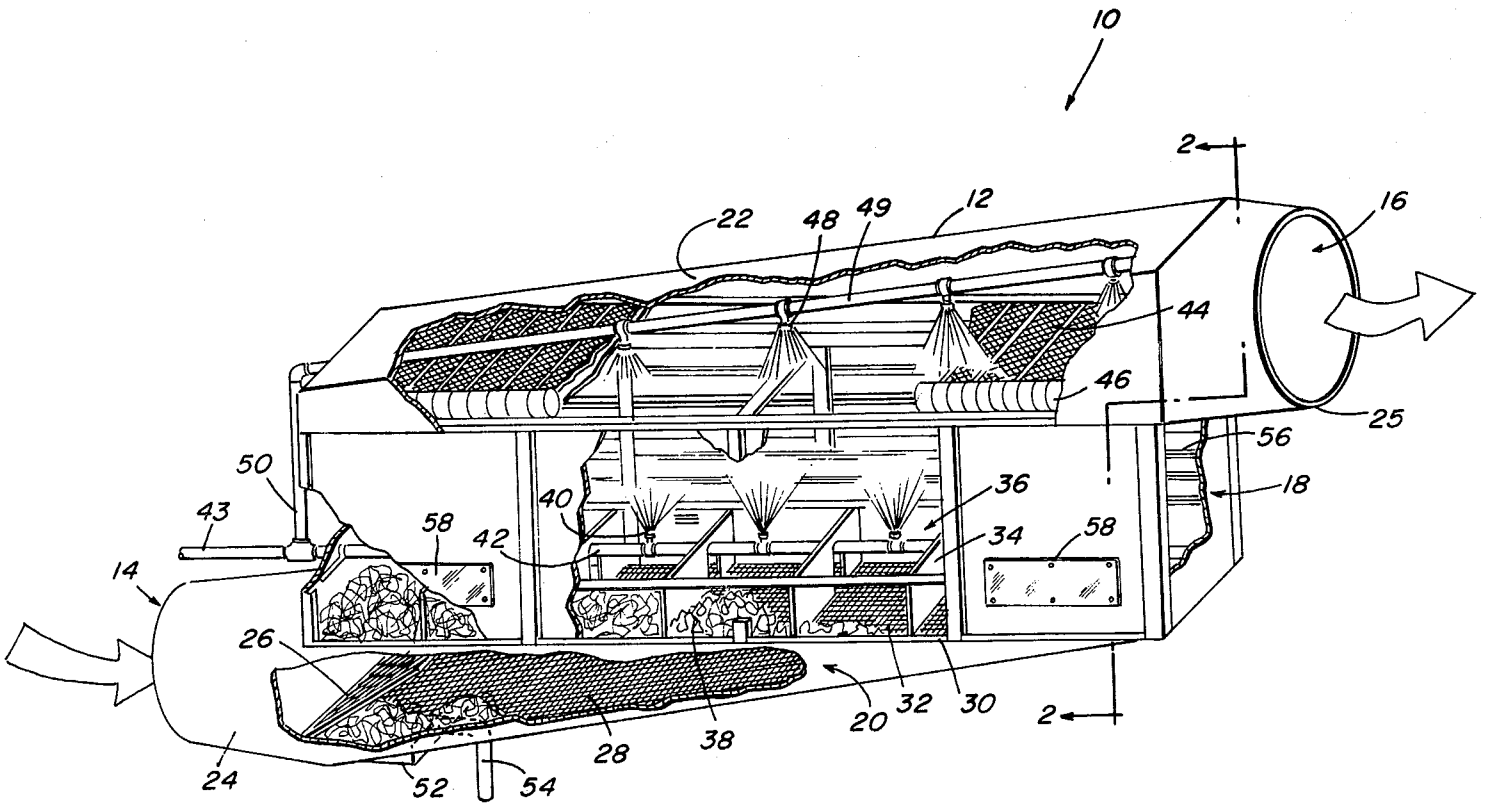
FIG. 1 is a perspective view, partly cut-away, of a heat exchanger embodying the present invention.

Referring now to the drawings, particularly FIG. 1, there is shown a heat exchanger 10 made in accordance with the present invention. In the illustrated embodiment, heat exchanger 10 is a direct contact air to water spray cooler with a housing 12 having a lower inlet port 14 and an upper outlet port 16 at opposite ends thereof.

Housing 12 includes a central spray chamber 18 that is opened to an inlet chamber 20 and an outlet chamber 22. Inlet port 14 includes a circular to rectangular transition member 24 which is connected to housing 12 at the entrance of inlet chamber 20. Outlet port 16 includes a rectangular to circular transmission member 25 which is connected to the housing 12 at exit of outlet chamber 22. Inlet chamber 20 tapers upwardly and inwardly from inlet port 14 toward the outlet port end of sprayer 10. The lower end of inlet chamber 20 is provided with a sump 52 which collects water and a drain 54 through which excess water and contaminates flow at a regulated velocity. That is, the flow through drain 54 is regulated so that the drain remains relatively full of water and no air escapes through the drain. Outlet chamber 22 tapers downwardly and inwardly from outlet port 16 toward the inlet port end of sprayer 10. A pair of lattice frameworks 26 and 28, for example, egg-crate structures, which are mounted in inlet chamber 20, deflect air that enters inlet port 14 from the mine ventilation system or from a blower (not shown) toward spray chamber 18.

Spray chamber 18 includes a framework 30 which carries a support structure 32, for example, a stainless steel mesh frame. A plurality of vertical plates 34, which are disposed in substantially parallel planes, are mounted to support structure 32 and form a plurality of compartments 36. Plates 34 define air flow straighteners that direct the air flow in chamber 20 upwardly into spray chamber 18. A water collecting stratum 38, e.g., a plastic mesh layer, is carried on frame 32 within each compartment 36. A plurality of nozzle assemblies 40 are connected to a manifold 42 which is connected to a cold water supply (not shown) via a conduit 43. One nozzle assembly 40 is disposed in each compartment 36. A spray of cool water from each nozzle assembly 40, e.g., a full 46° cone nozzle, is directed upwardly into spray chamber 18 and mists the air that has passed through plastic mesh layer 38.

Upper outlet chamber 22 is provided with a framework 44 that supports a water collecting or mist eliminating stratum 46, for example, a stainless steel mesh layer. A plurality of nozzle assemblies 48, which are connected to a manifold 49 and the cold water supply via a conduit 50, are directed downwardly towards mesh layer 46. As hereinafter described, nozzle assemblies 48 are provided to back flush and clean mesh layers 38 and 46 of dust accumulation.

Figure 2:
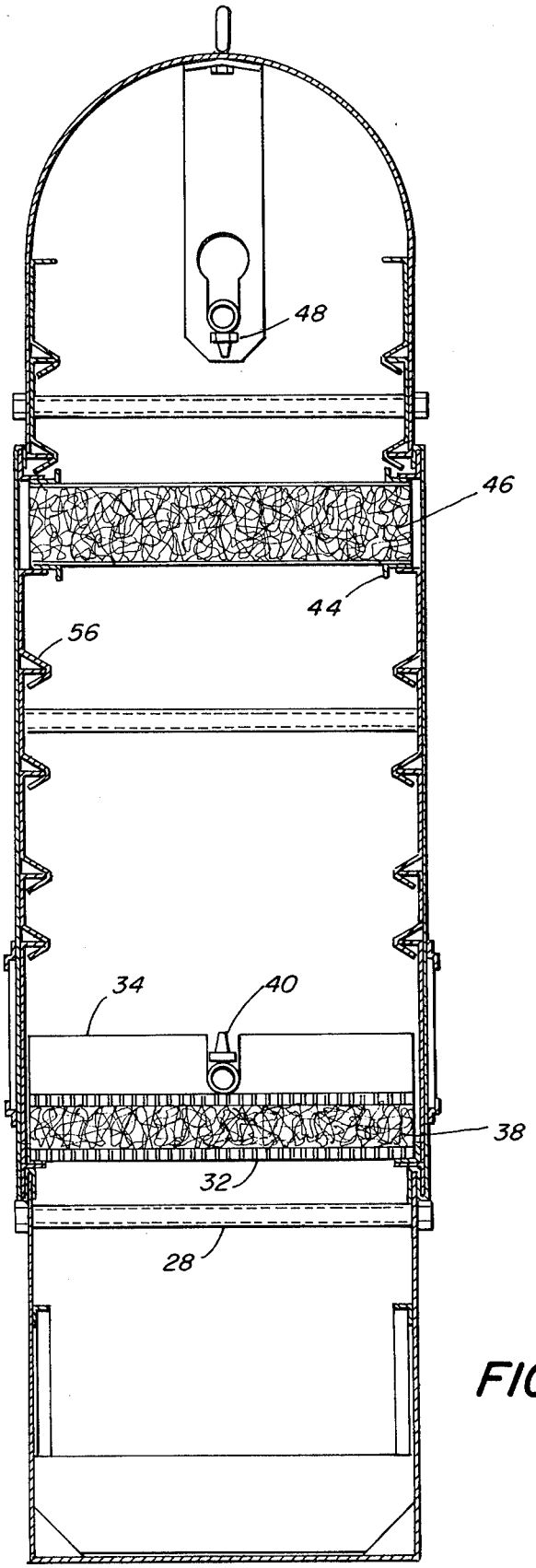
FIG. 2 is a sectional view taken along the lines 2—2 in FIG. 1.

As best shown in FIG. 2, the interior sidewalls of housing 12 are provided with a series of outwardly projecting triangular shaped fins 56 that are disposed in substantially horizontal rows within spray chamber 18. Any water that has collected on the sidewalls of spray chamber 18 drips toward the tip of fins 56 and into the air stream flowing within the chamber. In the illustrated embodiment, by way of example, housing 12 is approximately ten feet long, four feet high and one and a half feet wide. Also, in the illustrated embodiment, housing 12 is composed of galvanized steel. In an alternative embodiment, housing 12 is composed of a synthetic material, for example a plastic.

In operation of the invention, fresh ventilation air traveling through the mine's ventilation tubing enters cooler 10 through inlet port 14. The flowing air is turned upwardly and evenly distributed by egg-crate structures 26 and 28 which define air guide vanes. As the air moves upwardly through cooler 10, it first passes through mesh layer 38 and through spray chamber 18 where it is misted by the cold water spray from nozzle assemblies 40. Then, the air flows through mesh layer 46 which defines a mist eliminator. The cool air passing through mist eliminator 46 exists cooler 10 through outlet port 16.

It is to be noted that spray cooler 10 provides several stages of cooling and both parallel flow and counterflow cooling. As the incoming air flows upwardly through mesh layer 38, it is exposed to water flowing downwardly through the mesh layer to water sump 52 at the lower end of inlet chamber 20. The downwardly flowing water has fallen from nozzle assemblies 40 or has dripped from either upper mist eliminator 46 or fins 56. Since the downwardly falling water has been exposed to the upwardly flowing air in spray chamber 18, it is warmer than the water spray. However, this falling water is still colder than the incoming air. The air is cooled further as it is passed through the cold water sprays from nozzle assemblies 40 and the water dripping from mist eliminator 46. The air is cooled even further as it passes through upper mesh mist eliminator 46 which has collected some of the spray water from nozzle assemblies 40. In all cases, heat exchange is accomplished by direct contact between the warm mine ventilation air and the cooler water. For the illustrated embodiment, tests have shown that with an air flow rate of 4,000 cfm, inlet dry bulb temperature of 90° F.–93° F. wet bulb temperature of 80° F.–83° F., the outlet dry bulb and wet bulb temperatures are 75° F.–76° F. for an inlet water temperature of 50° F. at a flow rate of 12 gal/min. and a pressure of 100 lb/in$^2$.

As previously indicated, nozzle assemblies 48 are provided to flush cooler 10 of any accumulated dust. Generally, the spray from nozzle assemblies 40 is sufficient to maintain mesh layers 38 and 46 relatively free of dust. In this way, cooler 10 is substantially self-cleaning. However, in the event that dust does accumulate, nozzle assemblies 48 are energized to wash out both mesh layers 38 and 46. Inspection windows 58, composed of a transparent plastic, for example, are provided in the sidewalls of housing 12 for examining the condition of plastic mesh 38.

Since certain changes may be made in the foregoing disclosure without departing from the scope of the invention herein involved, it is intended that all matter contained in the above description and depicted in the accompanying drawings be construed in an illustrative and not in a limiting sense.

We claim:

1. An apparatus for cooling air supplied to underground mines by its direct contact with cooler water comprising:

a housing for the heat exchanger having structural elements therein which form an air inlet chamber to receive an air stream to be cooled and an upper outlet chamber to exhaust the cooled air stream;

said housing also having structural elements which form a water spray chamber between said inlet and outlet chambers, said spray chamber being in fluid communication with the inlet and outlet chambers;

an air inlet port in said housing in fluid communication with said air inlet chamber to receive air from the underground mine and allow it to enter the housing;

an air outlet port in the upper portion of said housing in fluid communication with the outlet chamber to allow cooled air to exit from the housing into the underground mine; air deflection means mount in said inlet chamber for deflecting the incoming air to be cooled into the spray chamber, said deflector means comprising a lattice shaped framework;

water collecting means mounted at the lower end of the inlet chamber;

water spray means mounted in said spray chamber for supplying a spray of water cooler than the air entering therein from the inlet chamber; and a mist eliminator mounted above the spray means in the housing, said eliminator comprising a mesh layer through which the air flows before leaving the outlet chamber whereby incoming mine air is deflected to the spray chamber wherein cooler water is sprayed thereon to cool the air, said sprayed water falling through the flow of incoming air to further cool the air until the water is discharged into the water collecting means.

2. The apparatus of claim 1 wherein there is a second water spray mounted in the housing above the mist eliminator and directed downwardly thereto and selectively operated when it is desired to wash away accumulated dust.

3. The apparatus of claim 1 also including a plurality of horizontally disposed fins mounted to the walls of the spray chamber, said fins acting to direct sprayed falling water into the air flow stream from the inlet chamber.

* * * * *